US005295690A

United States Patent [19]

Johnson

[11] Patent Number: 5,295,690

[45] Date of Patent: Mar. 22, 1994

[54] APPARATUS AND METHOD FOR IMPROVING A GOLF SWING

[76] Inventor: John Johnson, 8359 Montgomery Ct., Ventura, Calif. 93004

[21] Appl. No.: 922,537

[22] Filed: Jul. 30, 1992

[51] Int. Cl.[5] ..... A63B 69/36

[52] U.S. Cl. ..... 273/187.2; 273/189 R; 434/252

[58] Field of Search ..... 273/189 R, 187.2; 434/252

[56] References Cited

U.S. PATENT DOCUMENTS

| | | | |
|---|---|---|---|
| 1,655,092 | 1/1928 | Davis | 273/189 R |
| 2,022,910 | 12/1935 | Hanley | 273/189 R |
| 2,093,153 | 9/1937 | McCarthy | 273/189 R |
| 2,450,162 | 9/1948 | Promen | 273/189 R |
| 2,808,267 | 4/1955 | Heaton | 273/189 R |
| 3,069,169 | 12/1962 | Topping | 273/189 R |
| 3,106,718 | 10/1963 | Raab | 273/189 R X |
| 3,324,851 | 6/1967 | Posner | 273/189 R X |
| 3,419,277 | 12/1968 | Martin | 273/189 R |
| 3,642,960 | 2/1972 | Gentilly | 273/189 R X |
| 3,679,214 | 7/1972 | Boyte | 273/189 R |
| 3,680,869 | 8/1972 | Brady | 273/189 R X |
| 3,740,052 | 6/1973 | Arkin | 273/189 R |
| 3,970,316 | 7/1976 | Westmoreland, Jr. | 273/189 R |
| 4,058,852 | 11/1976 | Aragona | 273/189 R |
| 4,061,340 | 12/1977 | Husted | 273/189 R |
| 4,359,221 | 11/1982 | Taylor | 273/189 R X |
| 4,610,244 | 9/1986 | Hammond | 128/878 |
| 4,637,612 | 1/1987 | Wilkins | 273/187.2 |
| 4,662,640 | 5/1987 | Grander | 273/187.2 |
| 4,691,924 | 9/1987 | Strong | 273/189 R |
| 4,890,841 | 1/1990 | Brooks | 273/188 R |
| 4,892,317 | 1/1990 | Corder, Jr. | 273/189 R X |
| 4,895,373 | 1/1990 | Richmon | 273/189 R X |
| 4,940,237 | 7/1990 | Mortensen | 273/189 R |
| 4,960,280 | 10/1990 | Corder, Jr. | 273/189 R |
| 5,096,199 | 3/1992 | Wyatt et al. | 273/189 R |
| 5,154,416 | 10/1992 | Smull et al. | 273/187.2 X |

*Primary Examiner*—George J. Marlo
*Attorney, Agent, or Firm*—Thorpe, North & Western

[57] ABSTRACT

A golf swing teaching device includes two elastic arm cuffs which are interconnected and which each fit on one of the golfer's arm between the golfer's elbow and the golfer's shoulder such that the golfer's arms are biased toward each other while executing a golf swing. An elastic hip strap is connected to the arm cuff holding the trailing swing arm and includes a clamp which is secured to a point in proximity to the golfer's hip which is on the opposite side of the golfer's body as the golfer's trailing swing arm. As the golfer executes a golf back swing, the hip strap causes the golfer's hip to be rotated in the direction of the golfer's back swing. The position of the hip strap on the golfer's hip and the length of the hip strap can be adjusted to suit different golfers and the use of different clubs by individual golfers. In accordance with the method of the present invention, the golfer first repeatedly practices the golf swing with both arms in their respective arm cuffs. After sufficient practice, the golfer's leading arm is removed from its arm cuff and practice is continued with only the golfer's trailing swing arm being placed in an arm cuff. A fastener is provided to hold the empty arm cuff next to the other arm cuff when only one arm cuff is being used.

11 Claims, 4 Drawing Sheets

APPARATUS AND METHOD FOR IMPROVING A GOLF SWING

BACKGROUND

1. Field of the Invention

This invention relates to devices used to teach golfers to execute a proper golf swing.

2. The Prior Art

The popularity of the sport of golfing is continuing to increase. Even though many golfers seek out the advice of a teacher to improve their golf game, the mastery of a good golf swing still requires a great deal of practice. Unfortunately, without an accurate and consistent swing, many golfers find the game frustrating and even aggravating as some shots arrive exactly at their intended target while some easy shots land far into the rough. The discouragement of such golfers increases as they cannot repeatedly execute the golf swing which produces their occasional ideal shot.

The proper golf swing requires coordination between the golfer's arms and upper and lower portions of the golfer's torso, also sometimes referred to as the golfer's "upper and lower body," respectively. Several devices have been proposed in the past to improve a golfer's swing. Each of these devices, some of which work to some degree or another and some of which actually hinder golfers from learning a proper swing, neglect one or more pertinent areas of a golfer's body. For example, some devices only influence one, but not both, of a golfer's arms. Some other devices only influence a golfer's upper torso or lower torso, but not both. None of the previously available devices influence both of the arms and the lower torso, i.e., the hips, of a golfer.

One prior device is disclosed in U.S. Pat. No. 3,069,169 to Topping. The device shown in the Topping reference, while involving one of the golfer's arms and part of the golfer's body, does not suggest or teach, and actually teaches away from, involving both of the golfer's arms. Another prior device is disclosed in U.S. Pat. No. 4,890,841 to Brooks. The device shown in the Brooks reference is attached to both of the golfer's upper arms and encircles the golfer's upper body but does nothing for the golfer's lower arms or lower body. U.S. Pat. No. 4,960,280 to Corder, Jr. similarly attaches to both of a golfer's upper arms and upper body but does not coordinate the golfer's lower body with other parts of the body during the golf swing.

The prior devices disclosed in U.S. Pat. No. 2,093,153 to McCarthy and U.S. Pat. No. 4,895,373 to Richmond both attempt to coordinate the upper and lower body movement by connecting one of the golfer's shoulders to the opposing hip. Disadvantageously, both of these devices involve running a strap from one shoulder across the golfer's back to the opposing hip. Such devices undesirably promote harmful movement of the golfer's head during the swing and do nothing to control the movement of the golfer's arms and lower body during the swing.

In view of the above described problems in the art, it would be a great advancement to provide an apparatus and method for improving a golf swing.

BRIEF SUMMARY AND OBJECTS OF THE INVENTION

In view of the above described state of the art, the present invention seeks to realize the following objects and advantages.

It is a primary object of the present invention to provide a device which helps a golfer to improve his golf swing.

It is also an object of the present invention to provide a device which can be used by both beginning and advanced golfers to improve their golf swing.

It is another object of the present invention to provide a device which teaches golfers to turn their back to their target at the apex of the back swing of the golf swing.

It is a further object of the present invention to provide a device which teaches golfers to make a proper weight shift from one foot to another during the golf swing.

It is an even further object of the present invention to provide a device which teaches a golfer to properly use hip movements during a golf swing.

It is a still further object of the present invention to provide a device which teaches golfers to improve their golf swing and which is adjustable to the individual physical characteristics of the golfer.

It is another object of the present invention to provide a device which teaches golfers to improve their golf swing and which is adjustable to suit the characteristics of each golf club used by a golfer.

It is still another object of the present invention to provide a device which teaches golfers to improve their golf swing which is comfortable to wear and easy to use.

It is yet another object of the present invention to provide a method for improving the golf swing of a golfer which improves the coordination and use of the golfer's arms, the golfer's upper body, and the golfer's lower body.

These and other objects and advantages of the invention will become more fully apparent from the description and claims which follow, or may be learned by the practice of the invention.

The present invention provides a system and method for improving the golf swing of a golfer. The present invention simplifies the user's golf swing by limiting unnecessary movement during the swing and thus maximizing the force and accuracy with which the ball is hit. Use of the present invention allows a golfer's muscles to memorize the proper motions of the swing to improve the golfer's consistency.

The present invention preferably includes two elastic arm cuffs, each configured to fit on one of the golfer's arms between the golfer's elbow and the golfer's shoulder. The elastic arm cuffs function as the preferred example of an arm connecting means for providing a connecting point positioned on the golfer's arms. The two elastic arm cuffs are connected, either directly or via an interconnecting band, so that the golfer's arms are biased toward each other while executing the golf swing. The interconnecting band is the presently preferred example of an interconnecting means of the present invention.

An elastic hip strap is also provided in the preferred embodiment of the present invention. The hip strap is the presently preferred example of a hip attachment means of the present invention. The hip strap is attached at one end to the arm cuff holding the trailing swing arm and includes at another end a clamp which is adapted to secure the hip strap to a hip attachment point in proximity to the golfer's hip which is on the opposite side of the golfer's body as the golfer's trailing swing arm. As the golfer executes a golf back swing, the hip strap causes the golfer's hip to be rotated in the direction of the golfer's back swing. The position of the hip strap on the golfer's hip and the length of the hip strap can be adjusted to suit different golfers and the use of different clubs by individual golfers.

In accordance with the method of the present invention, the golfer first repeatedly practices the golf swing with both arms in their respective arm cuffs. After sufficient practice with both arms in their respective arm cuffs, practice continues with the leading arm removed from its arm cuff and with the trailing arm remaining in its arm cuff which is connected to the golfer's hip. A fastener adapted to hold the empty arm cuff against the other arm cuff is preferably provided.

BRIEF DESCRIPTION OF THE DRAWINGS

In order to better appreciate how the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference will now be made to the drawings wherein like structures will be provided with like reference designations.

Figure 1:
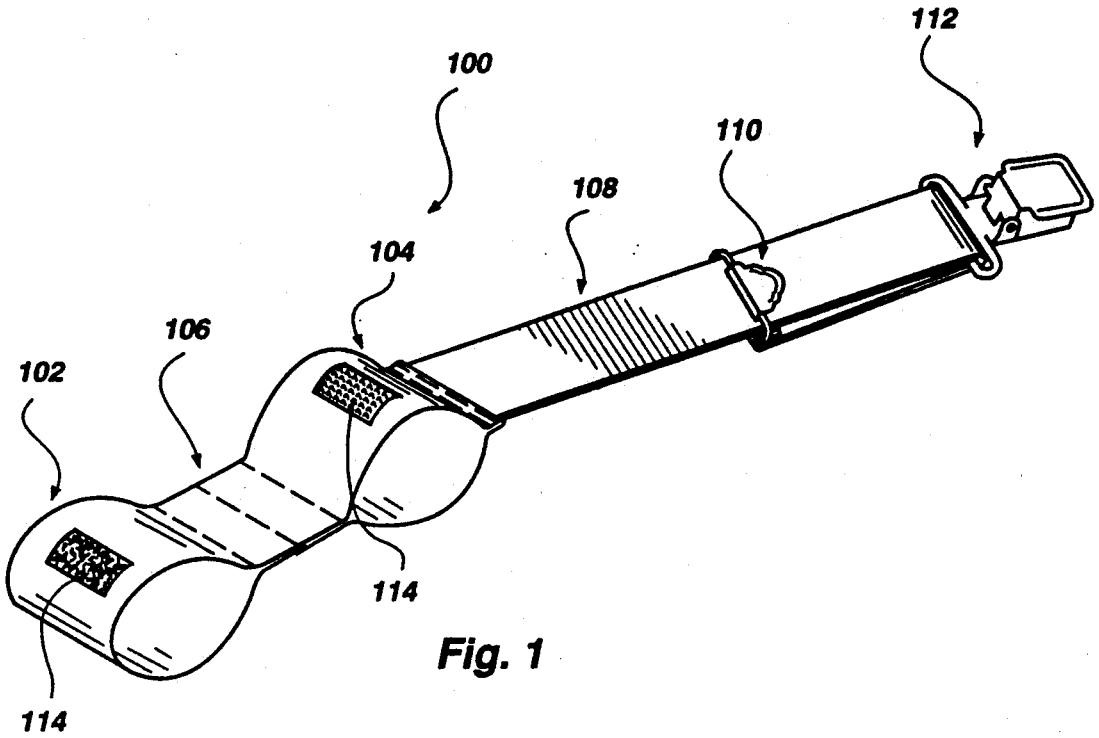
FIG. 1 is a perspective view of the presently preferred embodiment of the present invention.
Figure 2:
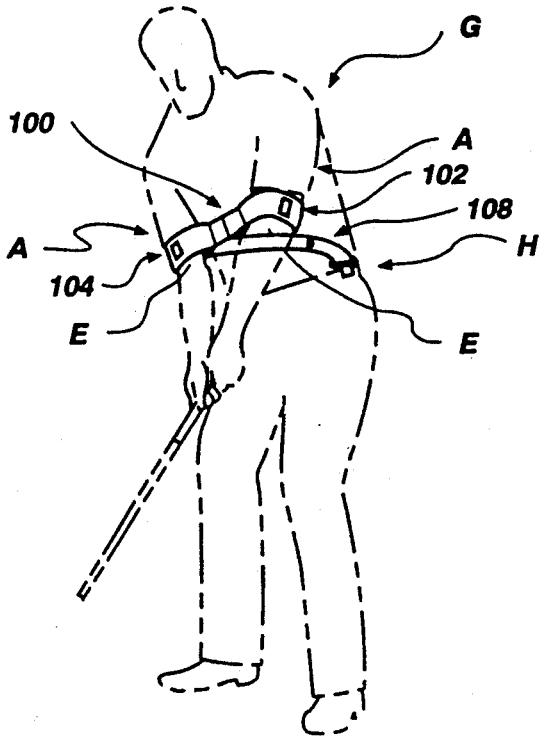
FIG. 2 is a perspective view of the device represented in FIG. 1 being used by a golfer in accordance with an early step in the method of the present invention.

Reference will first be made both to FIG. 1 and to FIG. 2. FIG. 1 is perspective view of the presently preferred embodiment of the golf swing teaching device 100 of the present invention while FIG. 2 shows a golfer using the preferred embodiment in accordance with one aspect of the method of the present invention. Simultaneous reference to the structure of the represented embodiment of the present invention (FIG. 1) and to its preferred use (FIG. 2) will help to explain the features and advantages of the present invention.

The golfer represented in the figures is right handed and the teaching device 100 will described for use with a right handed golfer. It will be appreciated that the teachings set forth herein can be readily applied to left handed golfers.

Represented in FIG. 1 is a first arm cuff and a second arm cuff, generally represented at 102 and 104, respectively. Each of the arm cuffs 102 and 104 is fabricated so that they fit around the upper arms A of a golfer G as indicated in FIG. 2. As shown in FIG. 2, the preferred position for the arm cuffs is just above the elbows E. It will be appreciated that, as is the case whenever dealing with the human body, differences which occur from golfer to golfer may require that the positions of the arm cuffs be adjusted to suit the physical characteristics of each golfer. Thus, as used herein, the term "upper arm" should be defined as that portion of the human arm located from the golfer's elbow to the golfer's shoulder.

It is preferred that the arm cuffs 102 and 104 be fabricated from an elastomeric material. The inner diameter of the arm cuffs 102 and 104 can be generally sized according to men's, women's, and children's sizes. It is preferred that the arm cuffs not have any snaps, buckles, or other structures which may irritate the golfer's skin since extensive practice with the present invention requires that the arm cuffs be against the golfer's skin for extended practice sessions. If necessary, different sizes of arm cuffs 102 and 104 can be produced for golfers having different size arms.

An interconnecting band, generally indicated at 106, joins the two arm cuffs 102 and 104. The interconnecting band 106 is also preferably fabricated from an elastomeric material which can be the same or different than the material from which the arm cuffs 102 and 104 is fabricated. It is preferred that the interconnecting band 106 and the arm cuffs 102 and 104 be fabricated from one continuous length of elastomeric material.

The interconnecting band 106 should have enough elasticity so that the arms A of the golfer G are pulled or biased together so as to hold the golfer's arms in the proper golf swing position. As with the arm cuffs 102 and 104, the interconnecting band 106 need not rigidly hold the arms A of the golfer in a particular position but should be selected so that arms are urged or biased into their proper golf swing position. It is within the scope of the present invention to fabricate the arm cuffs 102 and 104 and the interconnecting band 106 to be adjustable for the needs of a particular golfer.

In the illustrated preferred embodiment, the arm cuffs 102 and 104 each have a preferred inner diameter from about two inches to about four inches. The width of the material from which the arm cuffs 102 and 104 and the interconnecting band 106 is fabricated is preferably from about two inches to about four inches.

It will be appreciated that the described arm cuffs 102 and 104 and interconnecting band 106 structure alone is of use and benefit to a golfer trying to improve a golf swing since the golfer's arms are biased into the proper position. As explained earlier, however, a correct golf swing requires not only the proper positioning of the golfer'arms but also proper coordination between the golfer's lower torso, most importantly the hips, and other portions of the golfer's body. The present invention, in contrast to the previously available devices and methods, teaches the golfer the proper movement and positioning of both arms, the upper body, and the lower body, that is the golfer's hip H as indicated in FIG. 2, as will now be explained more fully.

Still referring to FIGS. 1 and 2, a hip strap 108 is attached to the arm cuff 104. The hip strap 108 is provided with a clamp 112 and an adjusting buckle 110. The adjusting buckle 110 can be any one of a number of devices available in the art to adjustably fix the length of the hip strap 108 as will be discussed in greater detail later. The clamp 112 is preferably one of many available in the art which can grip a variety of different materials. For example, the clamp 112 should be able to grip the golfer's pants, as represented in FIG. 2, as well as various belt type materials which may be worn by a golfer.

The present invention can be implemented using a clamp which is adapted to grip the golfer's pants or to grip a belt which the user provides or which is specifically adapted for use with the present invention. It is also within the scope of the present invention to provide a belt or other structure which is provided with spaced apart markings or fastening structures to which the hip strap 108 can be attached.

The inclusion of a structure to connect one arm cuff to a location adjacent to the golfer's hip, such as the represented hip strap 108, is critical to one aspect of the present invention. In order to teach the golfer to properly coordinate lower body movement with both arms, the hip strap 108 is necessary in the described embodiment. The hip strap 108 is preferably fabricated from an elastic material which will stretch and rebound as the golfer practices the back swing and follow through portions of the golf swing. The length, elasticity, and width of the hip strap 108 should all be considered when fabricating an embodiment of the present invention. Additional information regarding the hip strap 108, the components associated with it, and their preferred use will be described next.

Figure 3A:
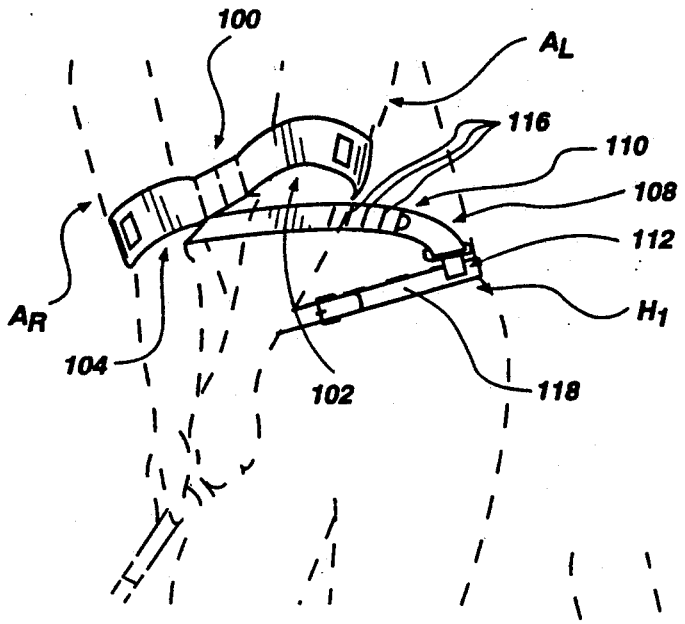
FIGS. 3A and 3B are enlarged perspective views of the device represented in FIG. 1 which has been adjusted to accommodate different golf clubs on the same user.
Figure 3B:
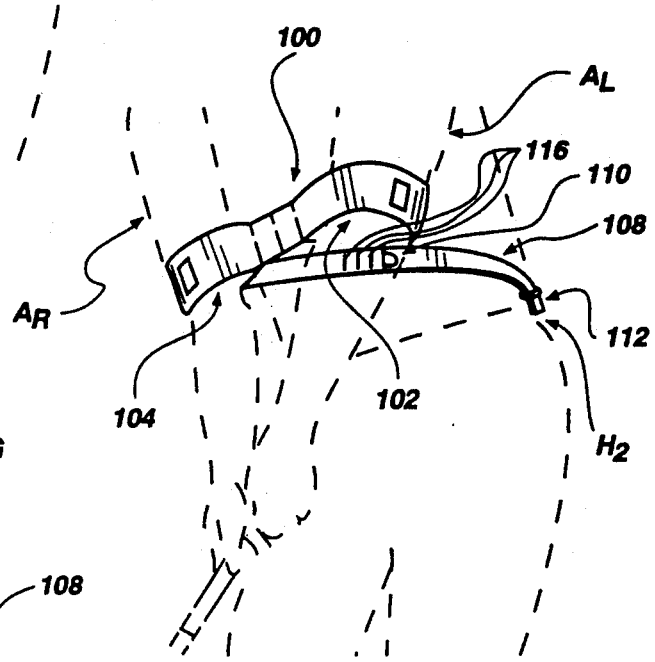

Reference will next be made to FIGS. 3A and 3B. FIGS. 3A and 3B provide partial perspective views of a golfer's hip and arms. In FIGS. 3A and 3B, the arm cuffs 102 and 104 are in position on the golfer's arms A. In FIG. 3A, the hip strap 108 has been adjusted to a first length as indicated by the length markings 116 and using the buckle 110. The clamp 112 is also represented as being attached to a first hip attachment point $H_1$ adjacent to the golfer's hip. The first length of the hip strap 108 is selected to provide maximum effectiveness for use with a particular golf club, for example, a number one driver. The first hip attachment point $H_1$ is selected to be in proximity to the golfer's hip in a position which provides maximum benefit for the golfer. The clamp 112 can be attached to an article of the golfer's clothing, for example pants, as shown in FIG. 3B, or, for example, a belt 118, as shown in FIG. 3A, can be provided.

Importantly, the length of the hip strap 108 should be adjusted for each golf club used by the golfer G. Thus, FIG. 3B shows the hip strap 108 being adjusted to a second length as indicated by the length markings 116. Different golfers may also find that a different hip attachment point, such as a second hip attachment point $H_2$ in FIG. 3B, is most advantageous. The different length of the hip strap 108 shown in FIG. 3B may be particularly advantageous for use with another golf club, for example a pitching wedge.

The selection of the length of the hip strap and the hip attachment point is best arrived at by experience for each golfer. General guidance applicable to all golfers, however, can be provided. One starting point for fitting the golf swing teaching device 100 to a right handed golfer's body will now be described. The preferred starting point includes attaching the clamp 112 as close as possible to the hip, i.e., adjacent to the ilium. The right arm $A_R$ is placed in the arm cuff 104 until the arm cuff 104 is directly above the elbow joint while still allowing the elbow joint to bend freely. The tension on the hip strap 108 is adjusted so that the hip strap 108 is minimally stretched when the golfer's relaxed right elbow lies directly to the right of the golfer's navel (not represented in the figures). The left arm $A_L$ is then placed into the arm cuff 102. The golfer is then ready to begin practicing and make any adjustments necessary in accordance with the method of the present invention.

Figure 4:
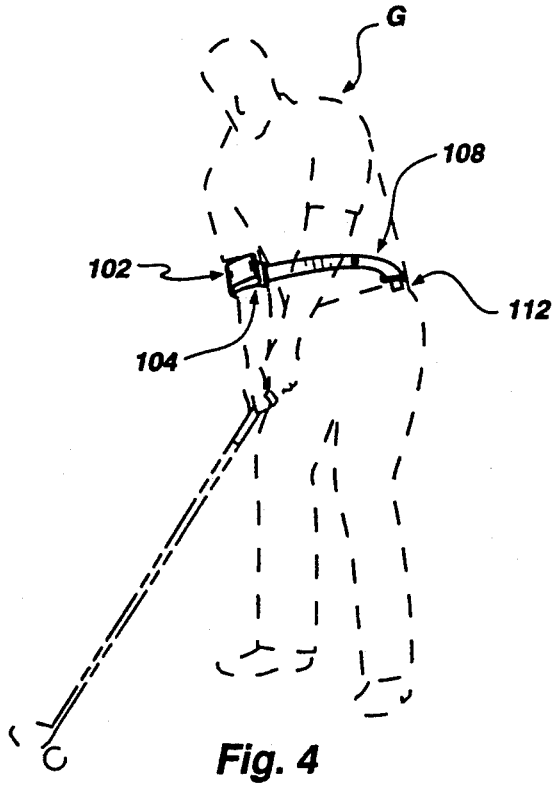
FIG. 4 is a perspective view of the device represented in FIG. 1 being used by a golfer in accordance with a later step in the method of the present invention than is represented in FIG. 1.

FIG. 4 provides a perspective view of the golf swing teaching device 100 which is represented in FIG. 1 being used by a golfer in accordance with a later step of the method of the present invention. Generally, in accordance with the method of the present invention, a golfer will first use the teaching device 100 with one arm inserted into each of the arm cuffs 102 and 104. After a golfer completes practicing with an arm inserted into each of the arm cuffs 102 and 104, the golfer moves onto a later step in the method of the present invention wherein only one arm is inserted into the arm cuff 104.

With the trailing arm (the arm which is farthest from the target) inserted into the arm cuff 104 and the clamp 112 attached to a hip attachment point as represented in FIG. 4, the teaching device 100 still coordinates the movement of the golfer's arms and hips while weaning the golfer from the aid provided when both arms were inserted into their respective arm cuffs 102 and 104. When only one arm cuff 104 is used, the unused arm cuff 102 (shown in phantom image in FIG. 4) is attached to the other arm cuff 104, for example by way of patches of hook and pile fasteners 114 provided on each arm cuff (FIG. 1).

Figure 5:
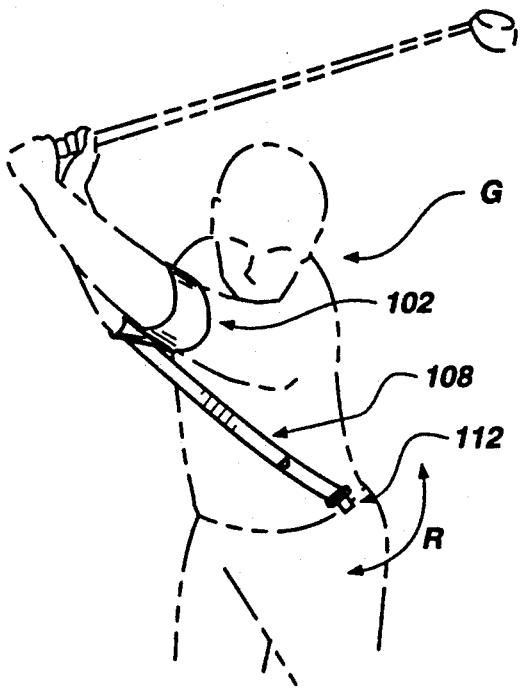
FIG. 5 is a perspective view of a golfer having reached the apex of the golf back swing using an embodiment of the present invention.

FIG. 5 is a perspective view of a golfer G using the present invention. Importantly, excess movement in a golfer's golf swing is reduced with the present invention in order to increase the effectiveness of the golf swing. At the apex of the golf back swing, the golfer's shoulder and back are turned toward the target and the hips rotate in the direction of arrow R. When the golfer shown in FIG. 5 has reached the apex of the golf back swing, the hip strap 108 should be adjusted so that there is significant tension on the golfer's arm. When the teaching device 100 is properly adjusted for the golfer, the golfer should feel as if the trailing arm is kept snug against the body during the back swing.

With the shoulders and the back of the golfer turned toward the golfer's target as illustrated in FIG. 5 at the apex of the back swing, the down swing of the golf swing should begin with movement of the golfer's hips with the arm cuffs 102 and 104 and arms being driven downward toward the golf ball (not represented). With the golfer's arms being relaxed as the swing starts, once the golf swing has reached the mid point the shift of weight from one foot of the golfer to the other is occurring and the momentum created by the movement of the golfer's hips and arms causes the golf ball to be hit with maximum force. Best described as "exploding" through the ball, the teaching device 100 allows the golfer to memorize the proper positioning and movement of the arms and hips to consistently carry out the most effective golf swing.

It is preferred that a nine iron or a pitching wedge club be used during practice carried out with both arms inserted into their respective arm cuffs 102 and 104. In some cases, it is also preferred that the golfer begin such practice without hitting any golf balls. When sufficient practice has been accomplished with both arms positioned in their respective arm cuffs, the left arm is removed from the arm cuff 102 and attached to the arm cuff 104 using the patches of hook and pile fastener (see FIG. 1 at 114) and practice is continued preferably starting with a number nine iron or pitching wedge club while hitting golf balls.

Figure 6:
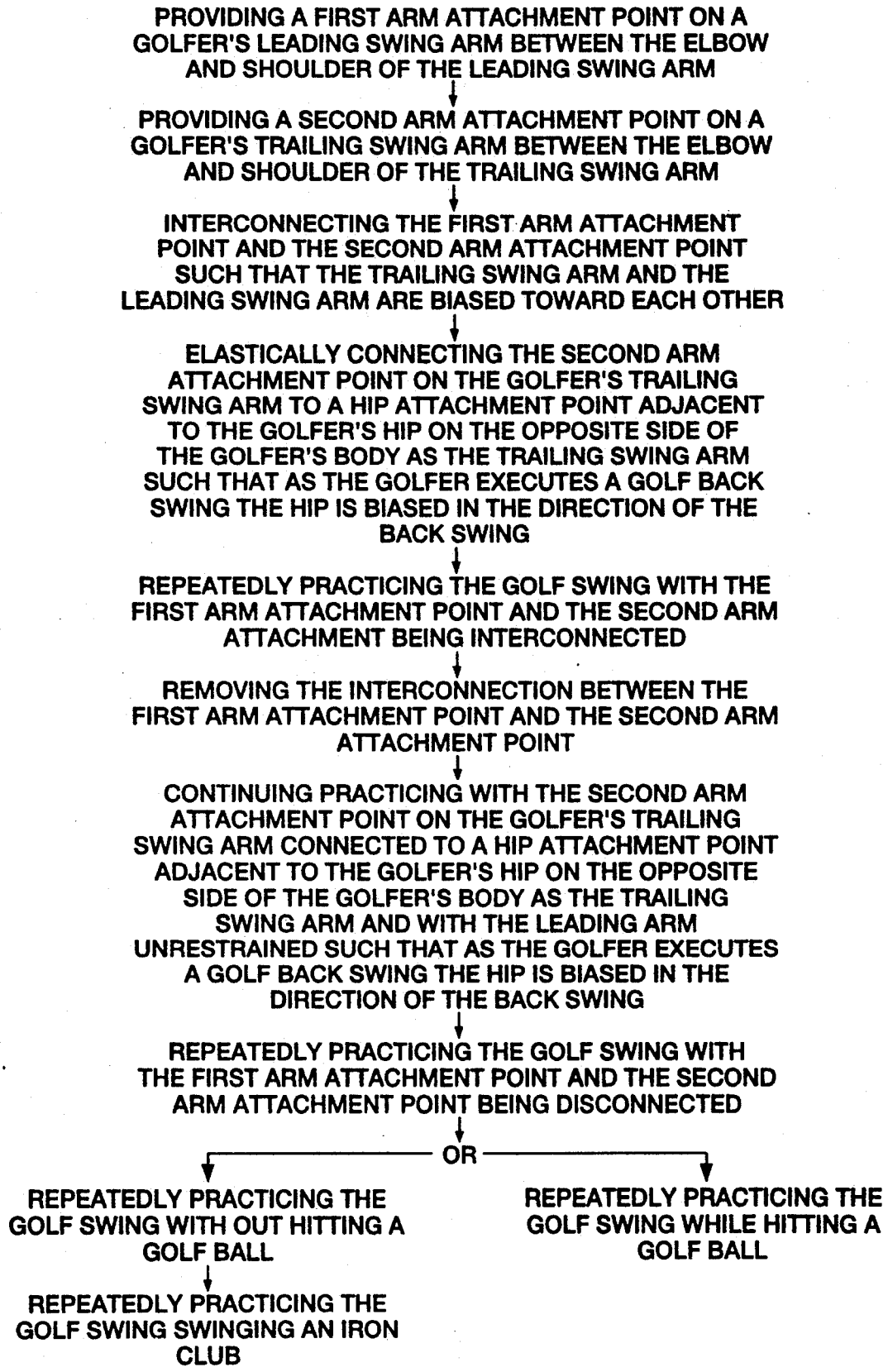
FIG. 6 is a flow chart representing the presently preferred steps of the present invention.

FIG. 6 illustrated the presently preferred steps of the present invention.

In view of the foregoing, it will be appreciated that the present invention provides a method and a device which can be used by both beginning and advanced golfers to improve their golf swing and which assists golfers with turning their back to the target at the apex of the back swing of the golf swing. The present invention also assists golfers to make a proper weight shift from one foot to another during their golf swing and to properly use hip movements during a golf swing. The embodiments of the present invention are also adjustable to the individual physical characteristics of the golfer and are adjustable to suit the characteristics of each golf club used by a golfer. The present invention represents a great improvement over the previously available devices and methods by improving the coordination and use of the arms, upper body, and the lower body of the golfer during a golf swing.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A golf swing teaching device comprising:

first arm connecting means for providing a first arm connecting point positioned on a golfer, the golfer having first and second arms, first ad second elbows, first and second shoulders, ad first and second hips, the first arm connecting point being positioned on the first arm between the first elbow and the first shoulder and not extending below the first elbow, the first arm connecting means comprising means for encircling the first arm and means for continuously adjusting the circumference of the means for encircling the first arm;

second arm connecting means for providing a second connecting point positioned on the second arm between the second elbow and the second shoulder and not extending below the second elbow, the second arm connecting means comprising means for encircling the second arm and means for continuously adjusting the circumference of the means for encircling the second arm, the second arm connecting means being connected to the first arm connecting means by an elastic member such that the distance between the first arm connecting means and the second arm connecting means is limited and such that the first arm is biased toward the second arm; and hip attaching means for attaching the first connecting means to an area in proximity to the first hip such that as the golfer executes a golf back swing the first hip is rotated in the direction of the golfer's back swing, the hip attaching means comprising a hip strap including:

a length of elastic material;

means for releasably securing the length of elastic material to a point adjacent to the golfer's ilium;

means for holdably adjusting the effective length of the length of elastic material; and a plurality of length markients provided on the hip strap such that the length of the hip strap can be repeatedly moved between a first length and a second length by the golfer as the golfer changes between different golf clubs.

2. A golf swing teaching device as defined in claim 1 wherein the first arm connecting means comprises a right arm connecting means and the hip attaching means comprises left hip attaching means.

3. A golf swing teaching device as defined in claim 1 wherein the first arm connecting means comprises a left arm connecting means and the hip attaching means comprises right hip attaching means.

4. A golf swing teaching device as defined in claim 1 wherein the arm connecting means comprises an elastic cuff.

5. A golf swig teaching device as defined in claim 1 wherein the means for securing the hip strap to a hip attachment point comprises a clamp positioned at a distal end of the hip strap.

6. A golf swing teaching device as defined in claim 1 further comprising:

a belt; and means for securing the hip attaching means to the belt.

7. A golf swing teaching device as defined in claim 1 further comprising means for releasably holding the first arm connecting means next to the second arm connecting means when one of the arm connecting means is not being used.

8. A method of teaching a golfer an improved golf swig comprising the steps of:

providing a first arm attachment point on a golfer's leading swing arm between the elbow and shoulder of the leading swing arm;

providing a second arm attachment point on a golfer's trailing swing arm between the elbow and shoulder of the trailing swing arm;

interconnecting the first arm attachment point and the second arm attachment point such that the trailing swing arm and the leading swing arm are biased toward each other and their distance apart from each other is limited;

elastically connecting the second arm attachment point on the golfer's trailing swing arm to a hip attachment point adjacent to the golfer's hip on the opposite side of the golfer's body as the trailing swing arm such that as the golfer executes a golf back swig the hip is biased in the direction of the back swing;

repeatedly practicing the golf swing with the first arm attachment point and the second arm attachment being interconnected;

removing the interconnection between the first arm attachment point and the second arm attachment point;

continuing practicing wit the second arm attachment point on the golfer's trailing swig arm connected to a hip attachment point adjacent to the golfer's hip on the opposite side of the golfer's body as the trailing swing arm and with the leading arm unrestrained such that as the golfer executes a golf back swing the hip is biased int he direction of the back swing; and repeatedly practicing the golf swing with the first arm attachment point and the second arm attachment point being disconnected.

9. A method of teaching a golfer an improved golf swing as defined in claim 8 wherein the step of repeatedly practicing the golf swing with the first arm attachment point and the second arm attachment being interconnected further comprises repeatedly practicing the golf swig with out hitting a golf ball.

10. A method of teaching a golfer an improved golf swing as defined in claim 9 wherein the step of repeatedly practicing the golf swing with the first arm attachment point and the second arm attachment being interconnected further comprises repeatedly practicing the golf swing swinging an iron club.

11. A method of teaching a golfer an improved golf swing as defined in claim 8 wherein the step of repeatedly practicing the golf swing with the first arm attachment point and the second arm attachment point being disconnected further comprises repeatedly practicing the golf swing while hitting a golf ball.

* * * * *